US007542021B2

(12) United States Patent
Kim et al.

(10) Patent No.: US 7,542,021 B2
(45) Date of Patent: Jun. 2, 2009

(54) COMMON VOLTAGE COMPENSATING CIRCUIT AND METHOD OF COMPENSATING COMMON VOLTAGE FOR LIQUID CRYSTAL DISPLAY DEVICE

(75) Inventors: In-Hwan Kim, Seoul (KR); Kyong-Seok Kim, Annyang-si (KR); Yeon-Sun Kim, Gangwon-do (KR)

(73) Assignee: LG Display Co., Ltd., Seoul (KR)

( * ) Notice: Subject to any disclaimer, the term of this patent is extended or adjusted under 35 U.S.C. 154(b) by 666 days.

(21) Appl. No.: 11/172,071

(22) Filed: Jun. 30, 2005

(65) Prior Publication Data

US 2006/0145995 A1 Jul. 6, 2006

(30) Foreign Application Priority Data

Dec. 30, 2004 (KR) ..... 10-2004-0116599

(51) Int. Cl.
*G09G 3/36* (2006.01)

(52) U.S. Cl. ..... 345/98

(58) Field of Classification Search ..... 345/98, 345/87, 204, 99–100
See application file for complete search history.

(56) References Cited

U.S. PATENT DOCUMENTS 5,760,757 A * 6/1998 Tanaka et al. ..... 345/93
5,818,402 A * 10/1998 Park et al. ..... 345/58
6,317,109 B1 * 11/2001 Lee ..... 345/87
6,756,958 B2 * 6/2004 Furuhashi et al. ..... 345/95

* cited by examiner

*Primary Examiner*—Amr Awad
*Assistant Examiner*—Stephen G Sherman
(74) *Attorney, Agent, or Firm*—Brinks Hofer Gilson & Lione

(57) ABSTRACT

A common voltage compensating circuit for a liquid crystal display device includes: a voltage distributing unit outputting a reference voltage; a deviation sensing unit detecting a deviation of a common voltage in a liquid crystal panel and outputting a deviation signal corresponding to the deviation of the common voltage; and a first compensating unit compensating the common voltage and outputting a first compensated common voltage by using the reference voltage, the deviation signal and an output thereof.

31 Claims, 8 Drawing Sheets

COMMON VOLTAGE COMPENSATING CIRCUIT AND METHOD OF COMPENSATING COMMON VOLTAGE FOR LIQUID CRYSTAL DISPLAY DEVICE

This application claims the benefit of Korean Patent Application No. 2004-0116599, filed in Korea on Dec. 30, 2004, which is hereby incorporated by reference.

BACKGROUND OF THE INVENTION

1. Field of the Invention

The present invention relates to a liquid crystal display device, and more particularly, to a display device including a common voltage compensating circuit and a method of compensating a common voltage.

2. Discussion of the Related Art

In general, a liquid crystal display (LCD) device includes a color filter substrate and an array substrate separated from each other by having a liquid crystal layer interposed there between, wherein the color filter substrate and the array substrate include a common electrode and a pixel electrode, respectively. When a voltage is supplied to the common electrode and the pixel electrode, an electric field is generated that changes the orientation of liquid crystal molecules of the liquid crystal layer due to optical anisotropy within the liquid crystal layer. Consequently, light transmittance characteristics of the liquid crystal layer is modulated and images are displayed by the LCD device.

Active matrix type LCD devices are commonly used because of their superiority in displaying moving images. Active matrix-type LCD devices include pixel regions disposed in a matrix form where a thin film transistor (TFT) is formed in the pixel region as a switching element.

An LCD device may be driven by a parity inversion method to prevent deterioration of a liquid crystal layer. In a parity inversion method, a polarity of a voltage applied to a pixel electrode is periodically inverted. A parity inversion method may be classified into a frame inversion method, a line inversion method and a dot inversion method. A dot inversion method, where a parity of a high level voltage of a data signal is periodically changed with a common voltage of a direct current (DC), is widely used because of its superiorities in display quality.

In an LCD device, a data signal of a data line, i.e., a pixel voltage is applied to a pixel electrode of an array substrate according to a state of a TFT, and a common voltage is applied to a common electrode of a color filter substrate. A liquid crystal layer between the pixel electrode and the common electrode is driven by a difference of the pixel voltage and common voltage to display images. While the liquid crystal layer is driven, however, a kickback voltage is generated due to a parasitic capacitance in the TFT. Accordingly, the pixel voltage deviates from the required value by the kickback voltage, and images having a required gray color are not displayed properly.

Moreover, when a data signal is changed from a first value corresponding to a black image to a second value corresponding to a white image, the common voltage deviates by a capacitance coupling due to the great difference between the first and second values of a data signal. In addition, when the LCD device is driven by a common voltage having a swing of a predetermined voltage difference, the common voltage deviation due to a capacitance coupling becomes greater. As a result, a horizontal cross-talk occurs and a display quality is deteriorated. The display quality of an LCD device is improved by a common voltage compensating circuit using feedback of a common voltage applied to the liquid crystal panel.

FIG. 1 is a schematic circuit diagram showing a common voltage compensating circuit according to the related art. In FIG. 1, a common voltage compensating circuit includes a voltage distributing unit 110 and a compensating unit 100. The voltage distributing unit 110 includes a resister "R" and a variable resistor "VR" in series between a source voltage "Vcc" and a ground. Accordingly, the source voltage "Vcc" is distributed to generate a distributed voltage. The compensating unit 100 includes an operational amplifier (OP AMP) "op" having an inverting input terminal (−), a non-inverting input terminal (+) and an output terminal. The distributed voltage from the voltage distributing unit 110 is input to the non-inverting input terminal (+) as a reference voltage and an output voltage of the OP AMP "op" is input to the inverting input terminal (−) by feedback. As a result, a first common voltage is generated using the reference voltage and a compensated common voltage is generated by feedback of the first common voltage.

In a common voltage compensating circuit according to the related art, however, the first common voltage input to the compensating unit 100 is not a resultant value used in a liquid crystal panel (not shown). After the first common voltage is applied to the liquid crystal panel, the first common voltage may deviate due to a state of the liquid crystal panel to be a second common voltage different from the first common voltage. Since the first common voltage not reflecting a state of the liquid crystal panel is used for compensation of a common voltage, the compensation of a common voltage is not exact and an improvement in display quality is limited. In addition, when the state of the liquid crystal panel changes during operation of the LCD device, the first common voltage should be amended manually.

SUMMARY OF THE INVENTION

Accordingly, the present invention is directed to a common voltage compensating circuit and a liquid crystal display device using the same that substantially obviates one or more of the problems due to limitations and disadvantages of the related art.

An object of the present invention is to provide a common voltage compensating circuit reflecting the state of a liquid crystal panel and a method of compensating the common voltage for a liquid crystal display device using the common voltage compensating circuit.

Another object of the present invention is to provide a common voltage compensating circuit where a voltage of a dummy common line is used for compensation of a common voltage and a method of compensating a common voltage for a liquid crystal display device using the common voltage compensating circuit.

Another object of the present invention is to provide a common voltage compensating circuit where a common voltage is automatically compensated during operation of a liquid crystal display device and a method of compensating a common voltage for a liquid crystal display device using the common voltage compensating circuit.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a common voltage compensating circuit for a liquid crystal display device includes: a voltage distributing unit outputting a reference voltage; a deviation sensing unit detecting the deviation of a common voltage in a liquid crystal panel and outputting a deviation signal corresponding to the deviation of the common voltage; and a first compensating unit compensating the common voltage and outputting a first compensated common voltage by using the reference voltage, the deviation signal and an output thereof.

In another aspect, a method of compensating a common voltage for a liquid crystal display device includes: generating a first common voltage using a reference voltage; detecting a deviation of the first common voltage in a liquid crystal panel to output a deviation signal corresponding to the deviation of the first common voltage; and compensating the first common voltage to output a first compensated common voltage by using the reference voltage, the deviation signal and the first common voltage.

In another aspect, a method of compensating a common voltage for a liquid crystal display device includes: generating a first common voltage using a reference voltage; generating a second common voltage using the first common voltage; detecting a deviation of the second common voltage in a liquid crystal panel to output a deviation signal corresponding to the deviation of the second common voltage; compensating the second common voltage to output a first compensated common voltage by using the reference voltage, the deviation signal and the first common voltage; and compensating the second common voltage to output a second compensated common voltage by using the first compensated common voltage, a control signal for inverting a parity of the first common voltage by frame and the second common voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to embodiments of the present invention, examples of which are illustrated in the accompanying drawings. Wherever possible, similar reference numbers will be used throughout the drawings to refer to the same or like parts.

Figure 1:
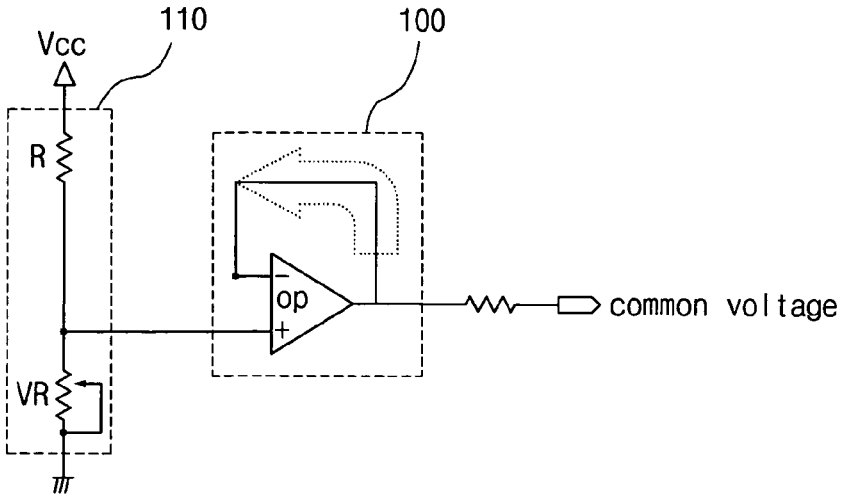
(related art) FIG. 1
FIG. 1 is a schematic circuit diagram showing a common voltage compensating circuit according to the related art.
Figure 2:
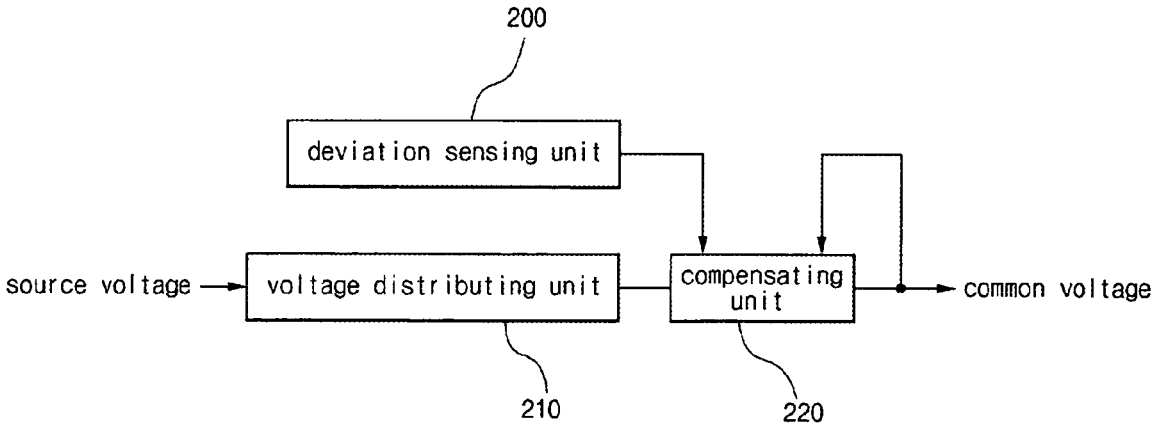
FIG. 2 is a schematic block diagram showing a common voltage compensating circuit for a liquid crystal display device according to an embodiment of the present invention.

FIG. 2 is a schematic block diagram showing a common voltage compensating circuit for a liquid crystal display device according to an embodiment of the present invention.

In FIG. 2, a common voltage compensating circuit includes a voltage distributing unit 210, a deviation sensing unit 200 and a compensating unit 220. The common voltage compensating circuit may be used for a liquid crystal display device driven by a dot inversion method. The voltage distributing unit 210 distributes a source voltage and supplies the distributed voltage to the compensating unit 220 as a reference voltage. The deviation sensing unit 200 detects a deviation of a common voltage in a liquid crystal panel of the liquid crystal display device and supplies the detected deviation of the common voltage to the compensating unit 220 as a feedback input. The compensating unit 220 compensates a common voltage using the reference voltage, the deviation of the common voltage in the liquid crystal panel and the output thereof.

Figure 3A:
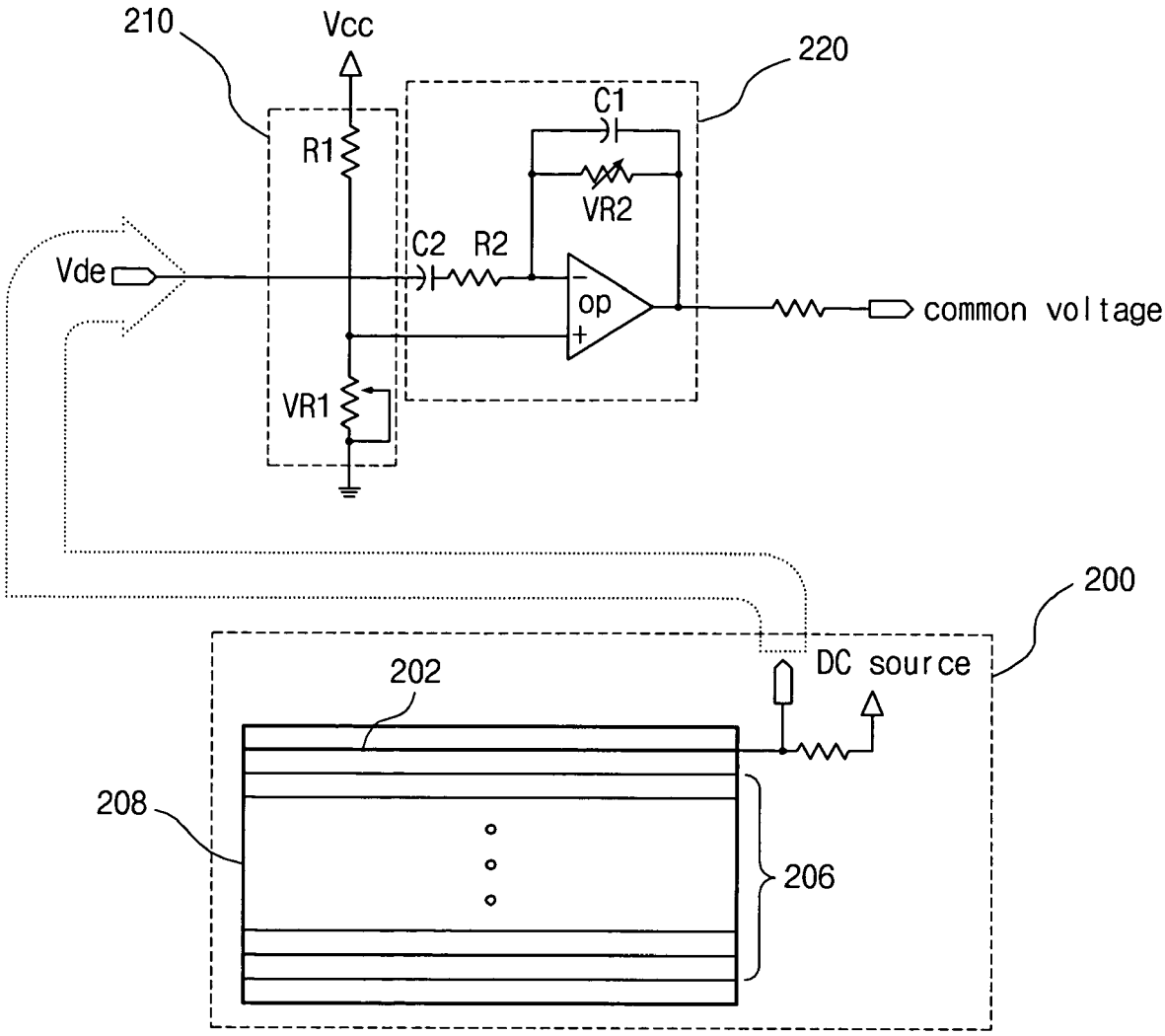
FIG. 3A is a schematic view showing a common voltage compensating circuit and a liquid crystal display panel according to an exemplary embodiment of FIG. 2.
Figure 3B:
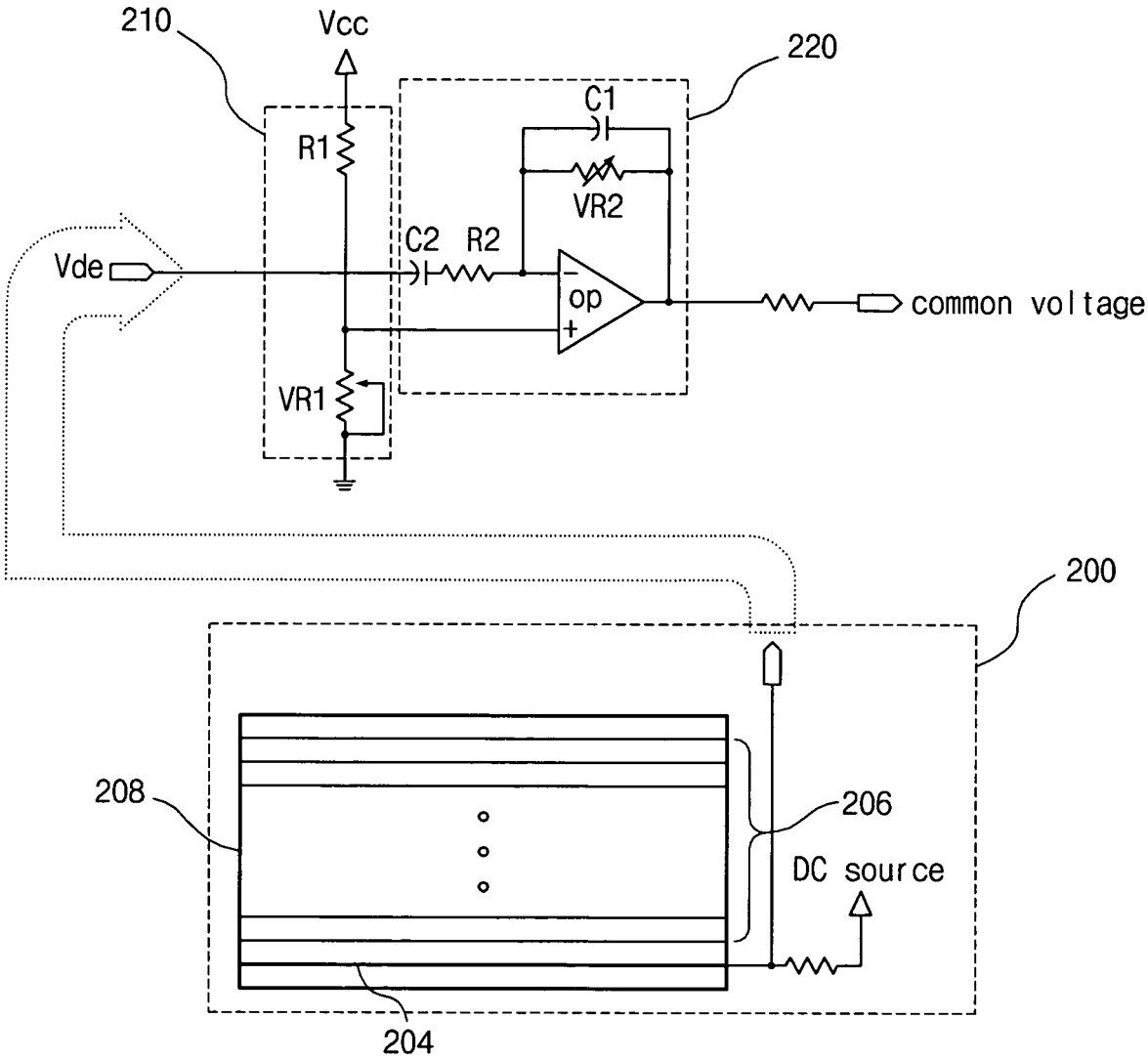
FIG. 3B is a schematic view showing a common voltage compensating circuit and a liquid crystal display panel according to another exemplary embodiment of FIG. 2.

FIG. 3A is a schematic view showing a common voltage compensating circuit and a liquid crystal display panel according to an exemplary embodiment of FIG. 2, and FIG. 3B is a schematic view showing a common voltage compensating circuit and a liquid crystal display panel according to another exemplary embodiment of FIG. 2. A deviation of a common voltage in a liquid crystal panel is detected by using an anterior dummy common line in FIG. 3A and by using a posterior dummy common line in FIG. 3B.

In FIGS. 3A and 3B, the voltage distributing unit 210 includes a first resistor "R1" and a first variable resistor "VR1" in series between a source voltage "Vcc" and a ground. The voltage distributing unit 210 distributes the source voltage "Vcc" by adjusting the first variable resistor "VR1" to output a distributed voltage as a reference voltage. The compensating unit 220 includes an operational amplifier (OP AMP) "op," a first capacitor "C1," a second capacitor "C2," a second resistor "R2" and a second variable resistor "VR2." The OP AMP "op" has an inverting input terminal (−), a non-inverting input terminal (+) and an output terminal. The first capacitor "C1" and the second variable resistor "VR2" are connected in parallel between the inverting input terminal (−) and the output terminal of the OP AMP "op," and the second capacitor "C2" and the second resistor "R2" are connected in series between the inverting input terminal (−) and a deviation signal input terminal "Vde." The reference voltage of the voltage distributing unit 210 is input to the non-inverting input terminal (+), and an output of the OP AMP "op" is input to the inverting input terminal (−) through the first capacitor "C1" and the second variable resistor "VR2."

In addition, a deviation of a common voltage in the deviation sensing unit 200 is input to the inverting input terminal (−) through the second capacitor "C2" and the second resistor "R2." After the OP AMP "op" outputs a first common voltage using the reference voltage, the first common voltage is supplied to a liquid crystal panel 208 and a second common voltage deviating from the first common voltage is detected as a deviation signal to be input to the OP AMP "op." As a result, the OP AMP "op" outputs a compensated common voltage using the reference voltage, the first common voltage and the deviation signal reflecting a difference between the first and second common voltages. Since a gain of the OP AMP "op" is determined by the second resistor "R2" and the second variable resistor "VR2," the compensating unit 220 may be adjusted by the second variable resistor "VR2." The first and second capacitors "C1" and "C2" are used to eliminate noise.

In FIG. 3A, the deviation sensing unit 200 includes an anterior dummy common line 202 in a liquid crystal panel 208 and a direct current (DC) source. The liquid crystal panel 208 has a plurality of common lines 206 used for displaying images and the anterior dummy common line 202 is formed in an upper portion of the plurality of common lines 206. Accordingly, the anterior dummy common line 202 is formed in a non-display area of the liquid crystal panel 208 and is not used for displaying images. The first common voltage output from the compensating unit 220 is applied to the liquid crystal panel 208. The first common voltage varies with the condition of the liquid crystal panel 208 to form a second common voltage. The deviation sensing unit 200 detects the second common voltage deviating from the first common voltage by using the DC source and a resistor, and supplies the deviation signal indicating a deviation of the second common voltage from the first common voltage to the compensating unit 220.

In FIG. 3B, the deviation sensing unit 200 includes a posterior dummy common line 204 in a liquid crystal panel 208 and a DC source. The liquid crystal panel 208 has a plurality of common lines 206 used for displaying images and the posterior dummy common line 204 is formed in a lower portion of the plurality of common lines 206. Accordingly, the posterior dummy common line 204 is formed in a non-display area of the liquid crystal panel 208 and is not used for displaying images. The first common voltage output from the compensating unit 220 is applied to the liquid crystal panel 208. The first common voltage varies with the condition of the liquid crystal panel 208 to form a second common voltage. The deviation sensing unit 200 detects the second common voltage deviating from the first common voltage by using the DC source and a resistor, and supplies the deviation signal indicating a deviation of the second common voltage from the first common voltage to the compensating unit 220.

Even though not shown in FIGS. 3A and 3B, the second common voltage may be detected using a dummy gate line. A thin film transistor (TFT) and a storage capacitor may be connected to the dummy gate line, and one of the anterior dummy common line or the posterior dummy common line is connected to the storage capacitor. Accordingly, the voltage of the dummy gate line is influenced by the voltage of the one of the anterior dummy common line or the posterior dummy common line, i.e., the second common voltage. When a detection voltage over about DC 2 V is applied to the dummy gate line, the detection voltage may vary with the second voltage through the storage capacitor connected to the dummy gate line. Since the variation in the detection voltage is proportional to the deviation of the second common voltage from the first common voltage, the variation in the detection voltage may be used for the compensating unit 220. The dummy gate line may be formed at an upper potion of the liquid crystal panel 208 or at a lower portion of the liquid crystal panel 208.

The deviation of the second common voltage in the lower portion of the liquid crystal panel 208 is greater than that in the upper portion of the liquid crystal panel 208. Accordingly, the variation in the detection voltage in the lower potion may be greater than that in the upper portion, and compensation of the common voltage by the dummy gate line in the lower portion may be more effective than that by the dummy gate line in the upper portion. Similarly, compensation of the common voltage by the posterior dummy common line may be more effective than that by the anterior dummy common line.

Operation of the common voltage compensating circuit of FIGS. 3A and 3B may be illustrated hereinafter. The source voltage "Vcc" is distributed in the voltage distributing unit 210 and the reference voltage of the distributed source voltage "Vcc" is input to the compensating unit 220, exactly, to the non-inverting input terminal (+) of the OP AMP "op1." The deviation of the common voltage in the liquid crystal panel 208 is detected either the anterior dummy common line 202, the posterior dummy common line 204 or the dummy gate line (not shown), and the deviation signal reflecting the deviation of the common voltage is input to the compensating unit 220, exactly, to the inverting input terminal (−) of the OP AMP "op." The OP AMP "op" of the compensating unit 220 receives the reference voltage from the voltage distributing unit 210, the first common voltage from the output terminal thereof and the deviation signal from the deviation sensing unit 200. Accordingly, the OP AMP "op" outputs a compensated common voltage using the reference voltage, the first common voltage and the deviation signal.

Contrary to a common voltage compensating circuit of the related art, a common voltage compensating circuit of FIGS. 2, 3A and 3B utilizes a deviation signal from a deviation sensing unit as well as a reference voltage of a voltage distributing unit and an output of a compensating unit. The deviation sensing unit detects a deviation in the common voltage through either an anterior dummy common line, a posterior dummy common line or a dummy gate line and generates the deviation signal corresponding to the deviation in a common voltage. Accordingly, the compensation of the common voltage is improved. Moreover, even when the state of the liquid crystal panel changes during operation of the LCD device, the common voltage compensating circuit of the present invention reflects the state change of the liquid crystal panel automatically.

Figure 4:
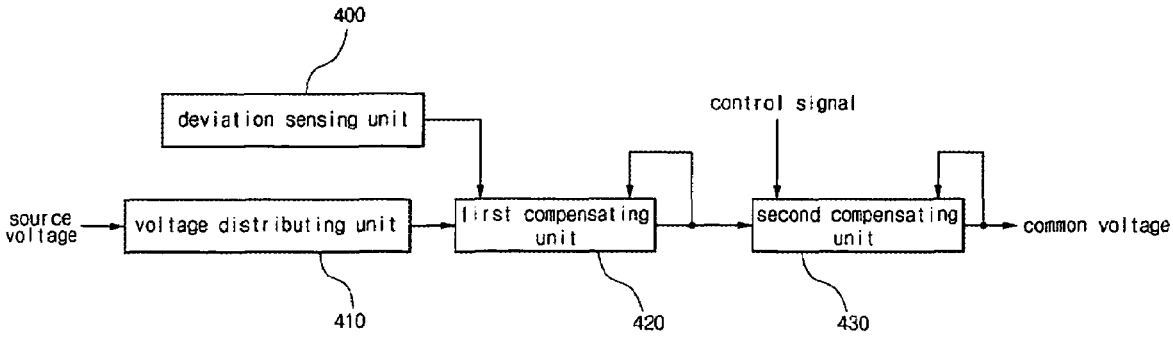
FIG. 4 is a schematic block diagram showing a common voltage compensating circuit for a liquid crystal display device according to another embodiment of the present invention.

FIG. 4 is a schematic block diagram showing a common voltage compensating circuit for a liquid crystal display device according to another embodiment of the present invention.

In FIG. 4, a common voltage compensating circuit includes a voltage distributing unit 410, a deviation sensing unit 400, a first compensating unit 420 and a second compensating unit 430. The common voltage compensating circuit may be used for a liquid crystal display device driven by a line inversion method or a frame inversion method with a common voltage having a swing. The voltage distributing unit 410 distributes a source voltage and supplies the distributed voltage to the first compensating unit 420 as a first reference voltage. The deviation sensing unit 400 detects the deviation of a common voltage in a liquid crystal panel of the LCD device and supplies the detected deviation of the common voltage to the first compensating unit 420 as a feedback input. The first compensating unit 420 outputs a first compensated common voltage using the first reference voltage and the deviation of the common voltage. The first compensated common voltage is used as a second reference voltage in the second compensating unit 220. The second compensating unit 220 outputs a second compensated common voltage using the second reference voltage, a control signal and the output thereof. The control signal may invert a parity of a common voltage by frame.

Figure 5A:
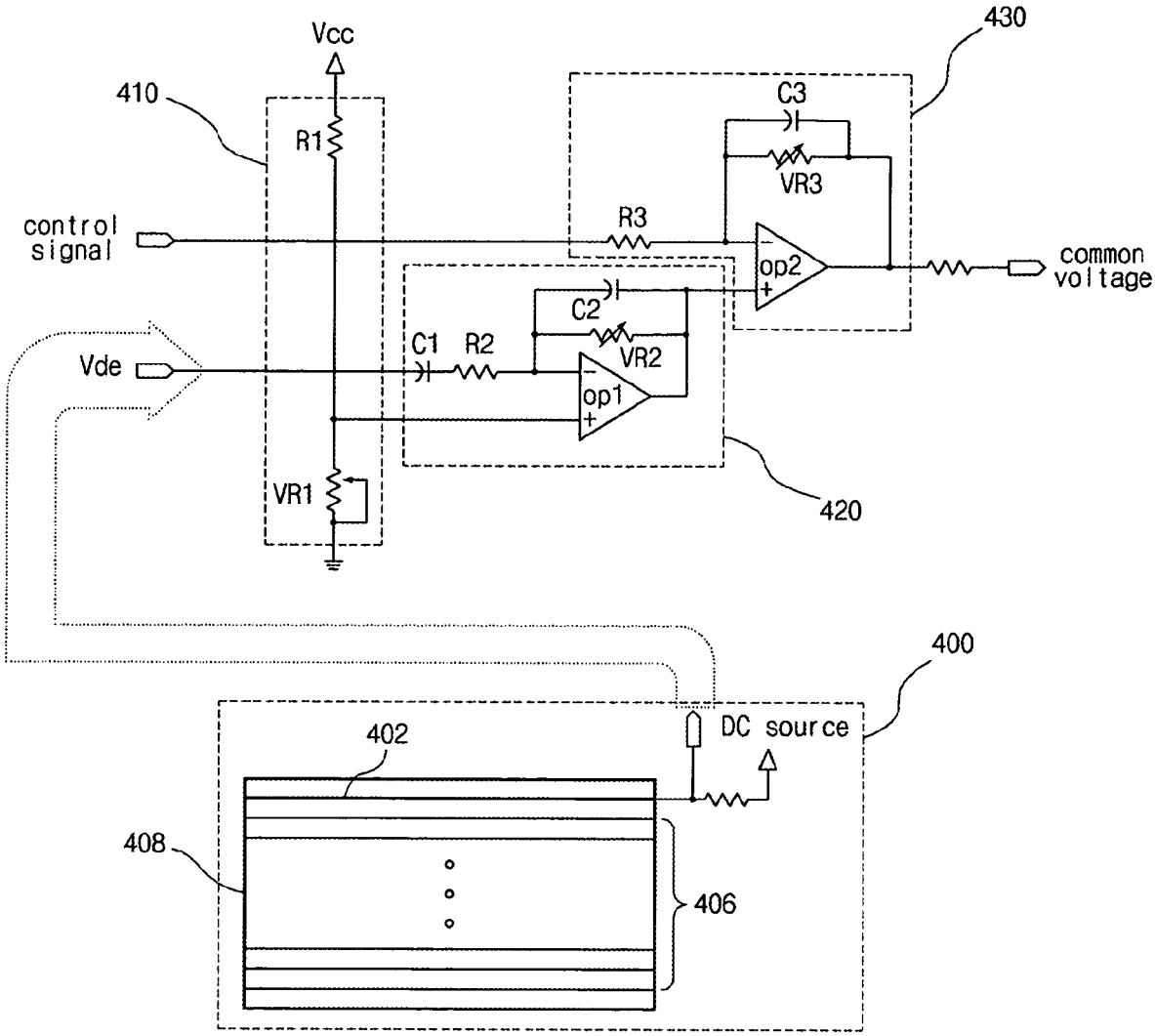
FIG. 5A is a schematic view showing a common voltage compensating circuit and a liquid crystal display panel having an anterior dummy common line according to an exemplary embodiment of FIG. 4.
Figure 5B:
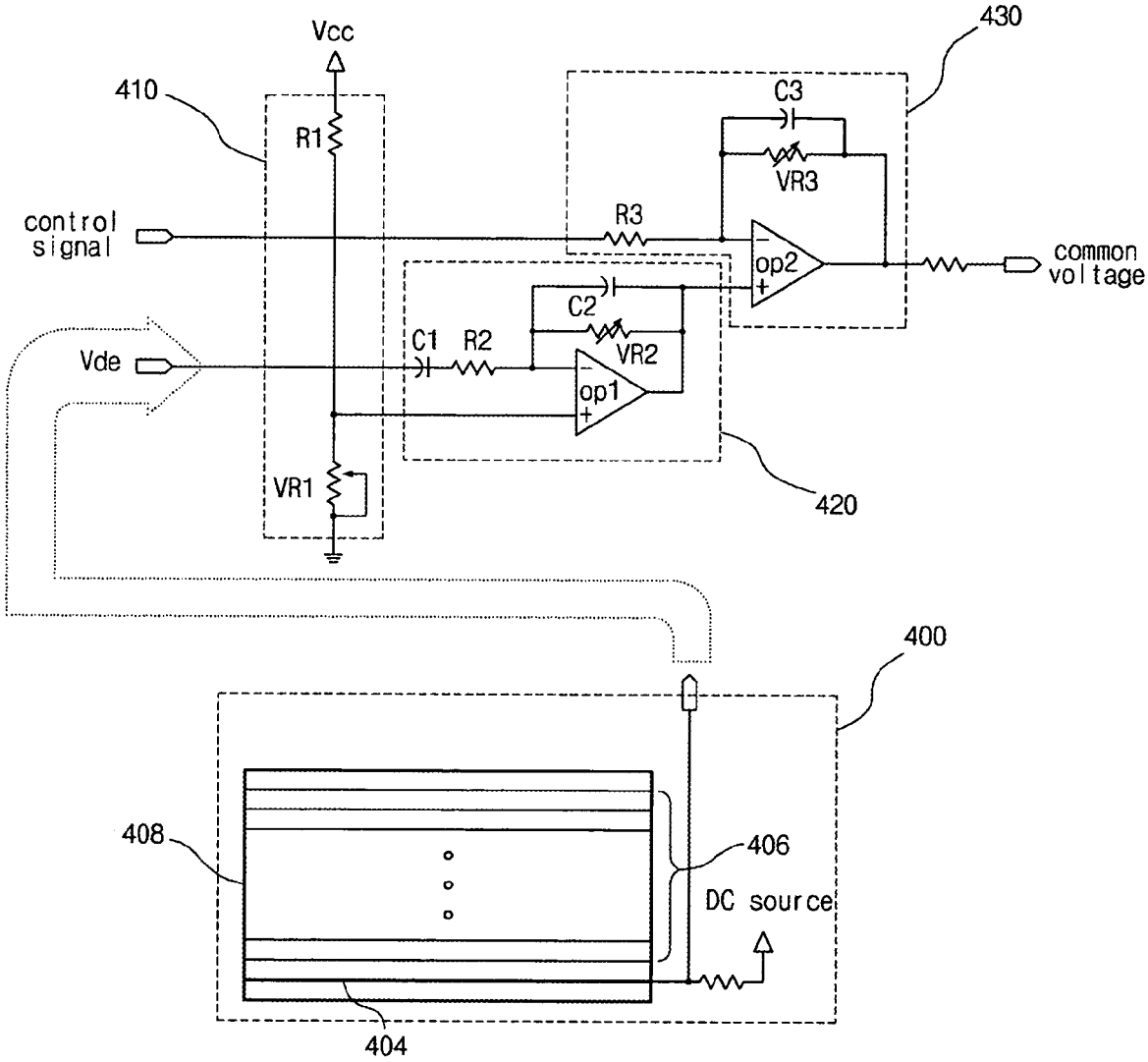
FIG. 5B is a schematic view showing a common voltage compensating circuit and a liquid crystal display panel having a posterior dummy common line according to another exemplary embodiment of FIG. 4.

FIG. 5A is a schematic view showing a common voltage compensating circuit and a liquid crystal display panel having an anterior dummy common line according to an exemplary embodiment of FIG. 4, and FIG. 5B is a schematic view showing a common voltage compensating circuit and a liquid crystal display panel having a posterior dummy common line according to another exemplary embodiment of FIG. 4.

In FIGS. 5A and 5B, the voltage distributing unit 410 includes a first resistor "R1" and a first variable resistor "VR1" in series between a source voltage "Vcc" and a ground. The voltage distributing unit 410 distributes the source voltage "Vcc" by adjusting the first variable resistor "VR1" to output a distributed voltage as a first reference voltage. The first compensating unit 420 includes a first operational amplifier (OP AMP) "op1," a first capacitor "C1," a second capacitor "C2," a second resistor "R2" and a second variable resistor "VR2." The first OP AMP "op1" has an inverting input terminal (−), a non-inverting input terminal (+) and an output terminal. The second capacitor "C2" and the second variable resistor "VR2" are connected in parallel between the inverting input terminal (−) and the output terminal of the first OP AMP "op1," and the first capacitor "C 1" and the second resistor "R2" are connected in series between the inverting input terminal (−) of the first OP AMP "op1" and a deviation signal input terminal "Vde." The first reference voltage of the voltage distributing unit 410 is input to the non-inverting input terminal (+), and an output of the first OP AMP "op1" is input to the inverting input terminal (−) through the second capacitor "C2" and the second variable resistor "VR2." As a result, the first OP AMP "op1" outputs a second reference voltage.

The second compensating unit 430 includes a second operational amplifier (OP AMP) "op2," a third capacitor "C3," a third variable resistor "VR3" and a third resistor "R3." The second OP AMP "op2" has an inverting input terminal (−), a non-inverting input terminal (+) and an output terminal. The third capacitor "C3" and the third variable resistor "VR3" are connected in parallel between the inverting input terminal (−) and the output terminal of the second OP AMP "op2," and the third resistor "R3" is connected between the inverting input terminal (−) of the second OP AMP "op2" and a control signal input terminal. The second reference voltage from the first compensating unit 420 is input to the non-inverting input terminal (+), and an output from the second OP AMP "op2" is input to the inverting input terminal (−) through the third capacitor "C3" and the third variable resistor "VR3."

In addition, a deviation signal corresponding to the deviation of a common voltage in a deviation sensing unit 400 is input to the inverting input terminal (−) of the first OP AMP "op1" through the first capacitor "C1" and the second resistor "R2." After the second OP AMP "op2" outputs a first common voltage using the second reference voltage of the first OP AMP "op1," the first common voltage is supplied to a liquid crystal panel 408 and a second common voltage deviating from the first common voltage is detected. The deviation sensing unit 400 may output the deviation in a common voltage as a deviation signal to the first OP AMP "op1." As a result, the first OP AMP "op1" outputs the second reference voltage using the first reference voltage, the deviation signal and the output thereof, and the second OP AMP "op2" outputs a compensated common voltage using the second reference voltage, a control signal inverting a parity of a common voltage by frame and the output thereof. Since a gain of the first OP AMP "op1" is determined by the second resistor "R2" and the second variable resistor "VR2," the first compensating unit 420 may be adjusted by the second variable resistor "VR2." Similarly, since a gain of the second OP AMP "op2" is determined by the third resistor "R3" and the third variable resistor "VR3," the second compensating unit 430 may be adjusted by the third variable resistor "VR3." The first, second and third capacitors "C1," "C2" and "C3" are used to eliminate noise.

In FIG. 5A, the deviation sensing unit 400 includes an anterior dummy common line 402 in a liquid crystal panel 408 and a direct current (DC) source. The liquid crystal panel 408 may have a plurality of common lines 406 used for displaying images and the anterior dummy common line 402 is disposed in an upper portion of the plurality of common lines 406. Accordingly, the anterior dummy common line 402 is disposed in a non-display area of the liquid crystal panel 408 and is not used for displaying images. The first common voltage output from the second compensating unit 430 is applied to the liquid crystal panel 408. The first common voltage varies with the state of the liquid crystal panel 408 to become a second common voltage different from the first common voltage. The deviation sensing unit 400 detects the second common voltage deviating from the first common voltage by using the DC source and a resistor, and supplies the deviation signal indicating the deviation of the second common voltage from the first common voltage to the first compensating unit 420.

In FIG. 5B, the deviation sensing unit 400 includes a posterior dummy common line 404 in a liquid crystal panel 408 and a DC source. The liquid crystal panel 408 has a plurality of common lines 406 used for displaying images and the posterior dummy common line 404 is disposed in a lower portion of the plurality of common lines 406. Accordingly, the posterior dummy common line 404 is disposed in a non-display area of the liquid crystal panel 408 and is not used for displaying images. The first common voltage output from the second compensating unit 420 is applied to the liquid crystal panel 408. The first common voltage varies with the state of the liquid crystal panel 408 to become a second common voltage different from the first common voltage. The deviation sensing unit 400 detects the second common voltage deviating from the first common voltage by using the DC source and a resistor, and supplies the deviation signal indicating a deviation of the second common voltage from the first common voltage to the first compensating unit 420.

Even though not shown in FIGS. 5A and 5B, the second common voltage may be detected using a dummy gate line. A thin film transistor (TFT) and a storage capacitor may be connected to the dummy gate line, and either the anterior dummy common line or the posterior dummy common line is connected to the storage capacitor. Accordingly, a voltage of the dummy gate line is influenced by a voltage of either the anterior dummy common line or the posterior dummy common line, i.e., the second common voltage. When a detection voltage over about DC 2 V is applied to the dummy gate line, the detection voltage may vary with the second voltage through the storage capacitor connected to the dummy gate line. Since the variation in the detection voltage is proportional to the deviation of the second common voltage from the first common voltage, the variation in the detection voltage may be used for the first compensating unit 420. The dummy gate line may be formed at an upper potion of the liquid crystal panel 408 or at a lower portion of the liquid crystal panel 408.

The deviation of the second common voltage in the lower portion of the liquid crystal panel 408 is greater than that in the upper portion of the liquid crystal panel 408. Accordingly, the variation in the detection voltage in the lower potion may be greater than that in the upper portion, and the compensation of a common voltage by the dummy gate line in the lower portion may be more effective than that by the dummy gate line in the upper portion. Similarly, the compensation of a common voltage by the posterior dummy common line may be more effective than that by the anterior dummy common line.

Operation of the common voltage compensating circuit of FIGS. 5A and 5B may be illustrated hereinafter. The source voltage "Vcc" is distributed in the voltage distributing unit 410 and the first reference voltage of the distributed source voltage "Vcc" is input to the first compensating unit 420, specifically to the non-inverting input terminal (+) of the first OP AMP "op1." The deviation of the common voltage in the liquid crystal panel 408 is detected by either the anterior dummy common line 402, the posterior dummy common line 404 or the dummy gate line (not shown), and the deviation signal reflecting the deviation of the common voltage is input to the first compensating unit 420, specifically to the inverting input terminal (−) of the first OP AMP "op1." The first OP AMP "op1" of the first compensating unit 420 receives the first reference voltage from the voltage distributing unit 410, the output from the output terminal thereof and the deviation signal from the deviation sensing unit 400. Accordingly, the first OP AMP "op1" outputs the second reference voltage using the first reference voltage, the deviation signal and the output thereof. The second reference voltage is input to the second compensating unit 430, and specifically to the non-inverting input terminal (+) of the second OP AMP "op2." The control signal inverting a parity of a common voltage by frame is input to the inverting input terminal (−) of the second OP AMP "op2." In addition, the output of the second OP AMP "op2" is re-input to the inverting input terminal (−) of the second OP AMP "op2." Accordingly, the second OP AMP "op2" outputs a compensated common voltage using the second reference voltage, the control signal and the output thereof.

Contrary to a common voltage compensating circuit of the related art, a common voltage compensating circuit of FIGS. 4, 5A and 5B utilizes a deviation signal from a deviation sensing unit as well as a reference voltage of a voltage distributing unit and an output from a second compensating unit. The deviation sensing unit detects a deviation in a common voltage through either an anterior dummy common line, a posterior dummy common line or a dummy gate line and generates the deviation signal corresponding to the deviation in a common voltage. Accordingly, the compensation of a common voltage is improved. Moreover, even when the state of the liquid crystal panel changes during operation of the LCD device, the common voltage compensating circuit of the present invention reflects the state change of the liquid crystal panel automatically.

Moreover, in the common voltage compensating circuit of FIGS. 4, 5A and 5B, a compensated common voltage is obtained through first and second compensating units. An output of the first compensating unit is input to the second compensating unit and the second compensating unit outputs a resultant compensated common voltage. Accordingly, a deviation signal corresponding to a deviation in a common voltage in the liquid crystal panel may be amplified through the first compensating unit and the second compensating unit generates a compensated common voltage using the amplified deviation signal. As a result, the compensation of the common voltage is improved. Since the first and second compensating units are adjusted by individual resistors, the compensation capability of the common voltage compensating circuit is also improved.

Furthermore, a common voltage compensating circuit of FIGS. 4, 5A and 5B adjusts a parity inversion of a compensated common voltage by a control signal. Accordingly, when an LCD device is driven with a common voltage having a swing, the common voltage compensating circuit compensates the common voltage oppositely to a parity of the deviation in the liquid crystal panel.

Figure 5C:
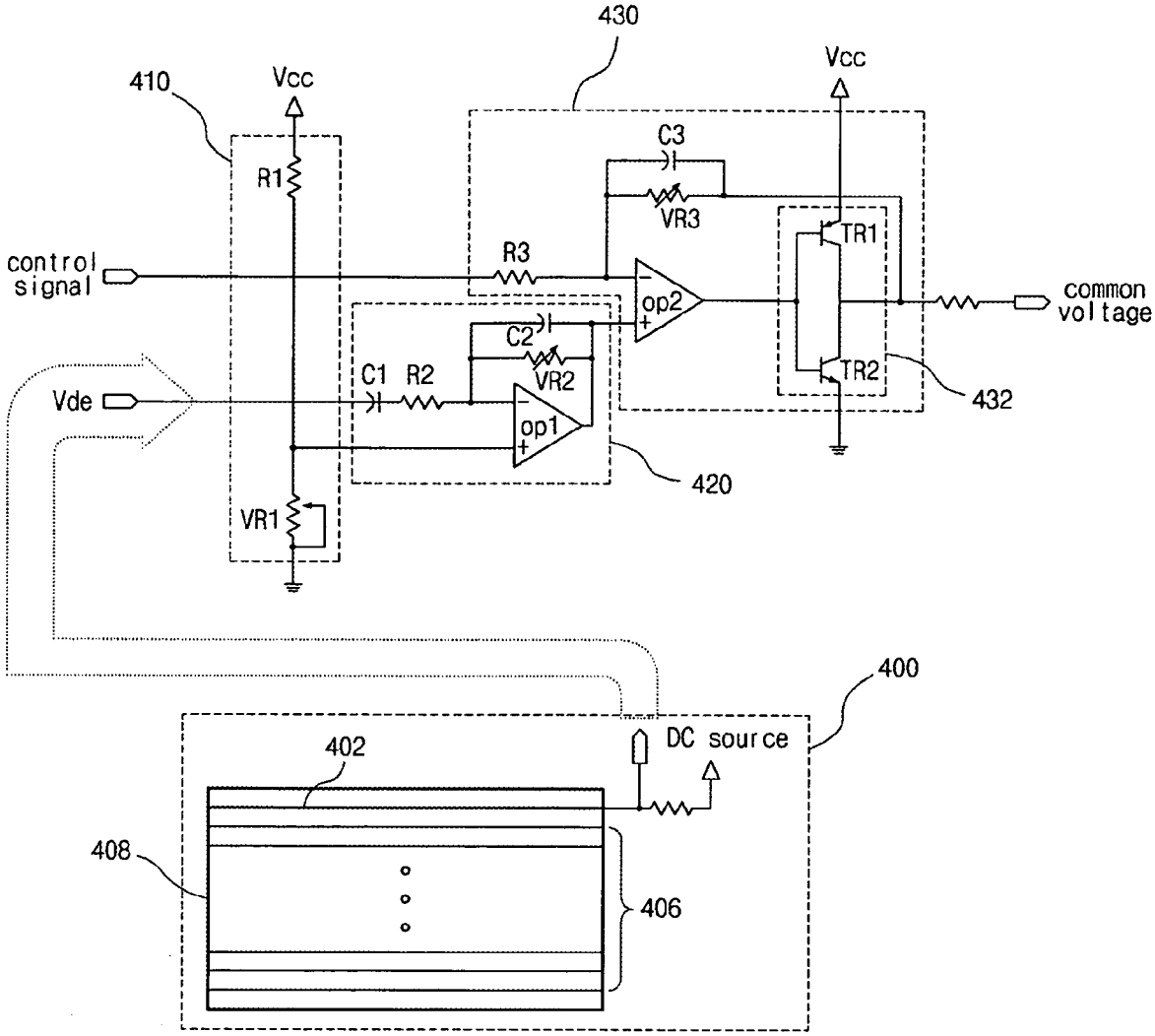
FIG. 5C is a schematic view showing a common voltage compensating circuit having an output buffer unit and a liquid crystal display panel having an anterior dummy common line according to another exemplary embodiment of FIG. 4.
Figure 5D:
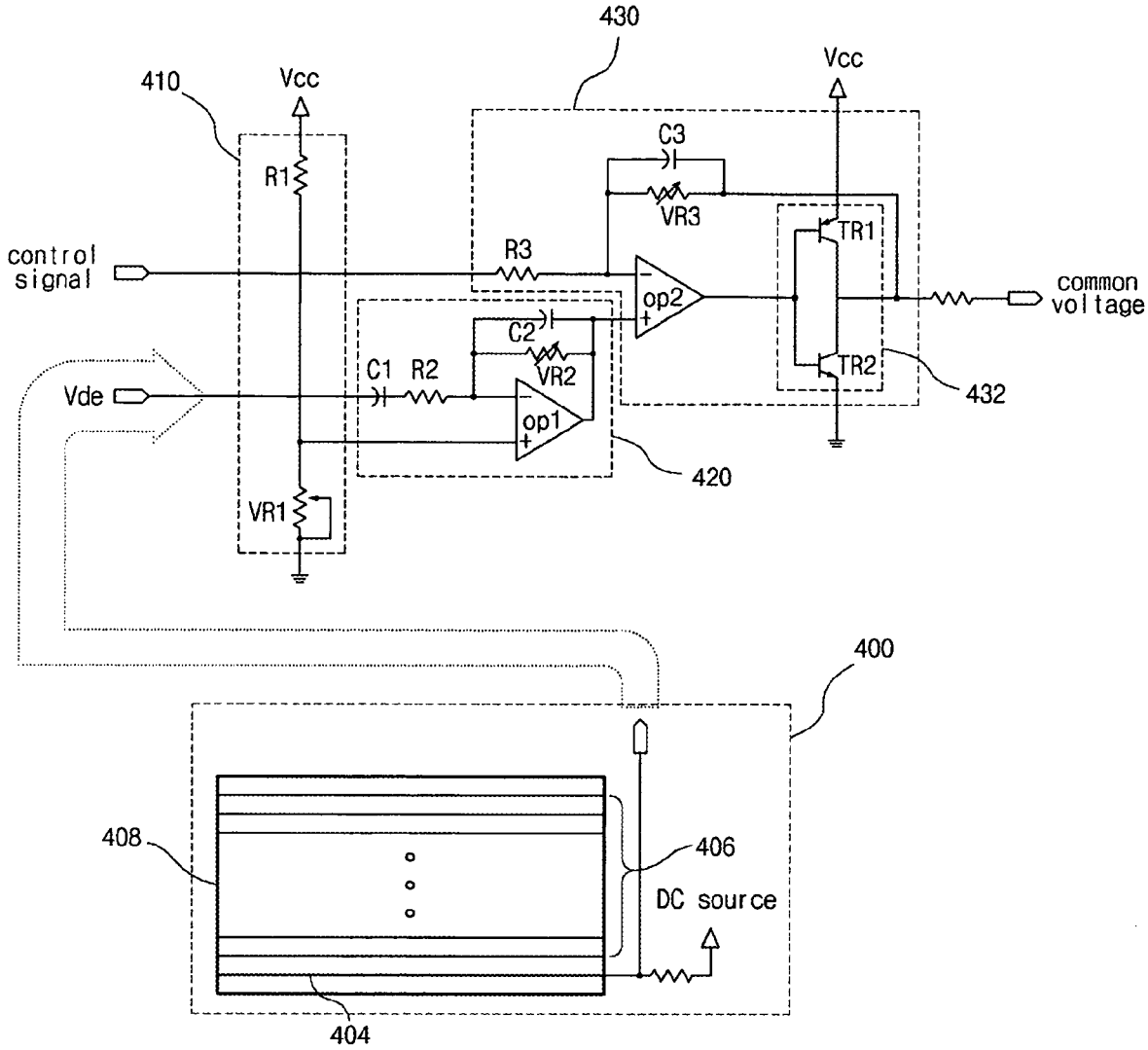
FIG. 5D is a schematic view showing a common voltage compensating circuit having an output buffer unit and a liquid crystal display panel having a posterior dummy common line according to another exemplary embodiment of FIG. 4.

FIG. 5C is a schematic view showing a common voltage compensating circuit having an output buffer unit and a liquid crystal display panel having an anterior dummy common line according to an exemplary embodiment of FIG. 4. FIG. 5D is a schematic view showing a common voltage compensating circuit having an output buffer unit and a liquid crystal display panel having a posterior dummy common line according to another exemplary embodiment of FIG. 4.

In FIGS. 5C and 5D, the voltage distributing unit 410 includes a first resistor "R1" and a first variable resistor "VR1" in series between a source voltage "Vcc" and a ground. The voltage distributing unit 410 distributes the source voltage "Vcc" by adjusting the first variable resistor "VR1" to output a distributed voltage as a first reference voltage. The first compensating unit 420 includes a first operational amplifier (OP AMP) "op1," a first capacitor "C1," a second capacitor "C2," a second resistor "R2" and a second variable resistor "VR2." The first OP AMP "op1" has an inverting input terminal (−), a non-inverting input terminal (+) and an output terminal. The second capacitor "C2" and the second variable resistor "VR2" are connected in parallel between the inverting input terminal (−) and the output terminal of the first OP AMP "op1," and the first capacitor "C1" and the second resistor "R2" are connected in series between the inverting input terminal (−) of the first OP AMP "op1" and a deviation signal input terminal "Vde." The first reference voltage of the voltage distributing unit 410 is input to the non-inverting input terminal (+), and an output of the first OP AMP "op1" is input to the inverting input terminal (−) through the second capacitor "C2" and the second variable resistor "VR2." As a result, the first OP AMP "op1" outputs a second reference voltage.

The second compensating unit 430 includes a second operational amplifier (OP AMP) "op2," a third capacitor "C3," a third variable resistor "VR3," a third resistor "R3" and an analog buffer 432. The second OP AMP "op2" has an inverting input terminal (−), a non-inverting input terminal (+) and an output terminal. The third capacitor "C3" and the third variable resistor "VR3" are connected in parallel between the inverting input terminal (−) and the output terminal of the second OP AMP "op2," and the third resistor "R3" is connected between the inverting input terminal (−) of the second OP AMP "op2" and a control signal input terminal. The analog buffer 432 is connected to the output terminal of the second OP AMP "op2." The analog buffer 432 stabilizes the output of the second OP AMP "op2." For example, the analog buffer 432 may include first and second transistors "TR1" and "TR2" connected in series between the source voltage "Vcc" and the ground. An output terminal of the analog buffer 432 including the first and second transistors "TR1" and "TR2" may be disposed at a node between the first and second transistors "TR1" and "TR2." The second reference voltage from the first compensating unit 420 is input to the non-inverting input terminal (+) of the second OP AMP "op2," and an output of the analog buffer 432 is input to the inverting input terminal (−) of the second OP AMP "op2" through the third capacitor "C3" and the third variable resistor "VR3."

In addition, a deviation signal corresponding to the deviation of a common voltage in a deviation sensing unit 400 is input to the inverting input terminal (−) of the first OP AMP "op1" through the first capacitor "C1" and the second resistor "R2." After the second OP AMP "op2" outputs a first common voltage using the second reference voltage of the first OP AMP "op1," the first common voltage is supplied to a liquid crystal panel 408 and a second common voltage deviating from the first common voltage is detected. The deviation sensing unit 400 may output the deviation in a common voltage as a deviation signal to the first OP AMP "op1." As a result, the first OP AMP "op1" outputs the second reference voltage using the first reference voltage, the deviation signal and the output thereof, and the second OP AMP "op2" outputs a compensated common voltage using the second reference voltage, a control signal inverting a parity of a common voltage by frame and the output of the analog buffer 432. Since a gain of the first OP AMP "op1" is determined by the second resistor "R2" and the second variable resistor "VR2," the first compensating unit 420 may be adjusted by the second variable resistor "VR2." Similarly, since a gain of the second OP AMP "op2" is determined by the third resistor "R3" and the third variable resistor "VR3," the second compensating unit 430 may be adjusted by the third variable resistor "VR3." The first, second and third capacitors "C1," "C2" and "C3" are used to eliminate noise.

In FIG. 5C, the deviation sensing unit 400 includes an anterior dummy common line 402 in a liquid crystal panel 408 and a direct current (DC) source. The liquid crystal panel 408 may have a plurality of common lines 406 used for displaying images and the anterior dummy common line 402 is disposed in an upper portion of the plurality of common lines 406. Accordingly, the anterior dummy common line 402 is disposed in a non-display area of the liquid crystal panel 408 and is not used for displaying images. The first common voltage output from the second compensating unit 430 is applied to the liquid crystal panel 408. The first common voltage varies with the state of the liquid crystal panel 408 to become a second common voltage different from the first common voltage. The deviation sensing unit 400 detects the second common voltage deviating from the first common voltage by using the DC source and a resistor, and supplies the deviation signal indicating a deviation of the second common voltage from the first common voltage to the first compensating unit 420.

In FIG. 5D, the deviation sensing unit 400 includes a posterior dummy common line 404 in a liquid crystal panel 408 and a DC source. The liquid crystal panel 408 has a plurality of common lines 406 used for displaying images and the posterior dummy common line 404 is disposed in a lower portion of the plurality of common lines 406. Accordingly, the posterior dummy common line 404 is disposed in a non-display area of the liquid crystal panel 408 and is not used for displaying images. The first common voltage output from the second compensating unit 420 is applied to the liquid crystal panel 408. The first common voltage varies with the state of the liquid crystal panel 408 to become a second common voltage different from the first common voltage. The deviation sensing unit 400 detects the second common voltage deviating from the first common voltage by using the DC source and a resistor, and supplies the deviation signal indicating a deviation of the second common voltage from the first common voltage to the first compensating unit 420.

Even though not shown in FIGS. 5C and 5D, the second common voltage may be detected using a dummy gate line. A thin film transistor (TFT) and a storage capacitor may be connected to the dummy gate line, and one of the anterior dummy common line and the posterior dummy common line is connected to the storage capacitor. Accordingly, a voltage of the dummy gate line is influenced by a voltage of the one of the anterior dummy common line and the posterior dummy common line, i.e., the second common voltage. When a detection voltage over about DC 2 V is applied to the dummy gate line, the detection voltage may vary with the second voltage through the storage capacitor connected to the dummy gate line. Since the variation in the detection voltage is proportional to the deviation of the second common voltage from the first common voltage, the variation in the detection voltage may be used for the first compensating unit 420. The dummy gate line may be formed at an upper potion of the liquid crystal panel 408 or at a lower portion of the liquid crystal panel 408.

The deviation of the second common voltage in the lower portion of the liquid crystal panel 408 is greater than that in the upper portion of the liquid crystal panel 408. Accordingly, the variation in the detection voltage in the lower potion may be greater than that in the upper portion, and the compensation of a common voltage by the dummy gate line in the lower portion may be more effective than that by the dummy gate line in the upper portion. Similarly, the compensation of a common voltage by the posterior dummy common line may be more effective than that by the anterior dummy common line.

Operation of the common voltage compensating circuit of FIGS. 5C and 5D may be illustrated hereinafter. The source voltage "Vcc" is distributed in the voltage distributing unit 410 and the first reference voltage of the distributed source voltage "Vcc" is input to the first compensating unit 420, specifically to the non-inverting input terminal (+) of the first OP AMP "op1." The deviation of the common voltage in the liquid crystal panel 408 is detected by one of the anterior dummy common line 402, the posterior dummy common line 404 and the dummy gate line (not shown), and the deviation signal reflecting the deviation of the common voltage is input to the first compensating unit 420, specifically to the inverting input terminal (−) of the first OP AMP "op1." The first OP AMP "op1" of the first compensating unit 420 receives the first reference voltage from the voltage distributing unit 410, the output from the output terminal thereof and the deviation signal from the deviation sensing unit 400. Accordingly, the first OP AMP "op1" outputs the second reference voltage using the first reference voltage, the deviation signal and the output thereof. The second reference voltage is input to the second compensating unit 430, and specifically to the non-inverting input terminal (+) of the second OP AMP "op2." The control signal inverting a parity of a common voltage by frame is input to the inverting input terminal (−) of the second OP AMP "op2." The output of the second OP AMP "op2" is input to the analog buffer 432 and the output of the analog buffer inputs to the inverting input terminal (−) of the second OP AMP "op2." Accordingly, the second OP AMP "op2" outputs a compensated common voltage through the analog buffer 432 using the second reference voltage, the control signal and the output of the analog buffer 432.

Contrary to a common voltage compensating circuit of the related art, a common voltage compensating circuit of FIGS. 4, 5C and 5D utilizes a deviation signal from a deviation sensing unit as well as a reference voltage of a voltage distributing unit and an output of a second compensating unit. The deviation sensing unit detects the deviation in a common voltage through either an anterior dummy common line, a posterior dummy common line or a dummy gate line and generates the deviation signal corresponding to the deviation in the common voltage. Accordingly, the compensation of the common voltage is improved. Moreover, even when a state of the liquid crystal panel changes during operation of the LCD device, the common voltage compensating circuit of the present invention reflects the state change of the liquid crystal panel automatically.

Moreover, a compensated common voltage is obtained through first and second compensating units. An output of the first compensating unit is input to the second compensating unit and the second compensating unit outputs a resultant compensated common voltage. Accordingly, a deviation signal corresponding to the deviation in the common voltage in the liquid crystal panel may be amplified through the first compensating unit, and the second compensating unit generates a compensated common voltage using an amplified deviation signal. As a result, the compensation of a common voltage is improved. Since the first and second compensating units are adjusted by individual resistors, the compensation capability of the common voltage compensating circuit is also improved.

Furthermore, a common voltage compensating circuit of FIGS. 4, 5C and 5D adjusts a parity inversion of a compensated common voltage by a control signal. Accordingly, when an LCD device is driven with a common voltage having a swing, the common voltage compensating circuit compensates the common voltage oppositely to a parity of the deviation in the liquid crystal panel. In addition, since a second compensating unit includes an analog buffer, the stability and the current-driving capability of the compensated common voltage are improved.

A common voltage compensating circuit of the present invention may be applied to an LCD device including a storage capacitor of a storage on previous gate type as well as an LCD device including a storage capacitor of a storage on common type. In addition, a common voltage compensating circuit may be applied to a twisted nematic (TN) mode LCD device as well as an in-plane switching (IPS) mode LCD device. In addition, a common voltage compensating circuit of the present invention may be applied to an LCD device having two common electrodes alternately disposed on a color filter substrate as well as an LCD device having a common electrode formed on an entire surface of a color filter substrate.

Consequently, in a common voltage compensating circuit of the present invention, a deviation of a common voltage in a liquid crystal panel is detected using either a anterior dummy common line, a posterior dummy common line or a dummy gate line, and the detected deviation of a common voltage is used for compensating a common voltage. Accordingly, the efficiency and the accuracy of the compensation are improved. In addition, a compensation capability is adjusted, and a compensation is automatically performed when a state of a liquid crystal panel changes.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A common voltage compensating circuit for a liquid crystal display device, comprising:

a voltage distributing unit outputting a reference voltage;

a deviation sensing unit detecting a deviation of a common voltage in a liquid crystal panel and outputting a deviation signal corresponding to the deviation of the common voltage; and a first compensating unit coupled with the voltage distributing unit and the deviation sensing unit, wherein the first compensating unit compensates the common voltage by outputting a first compensated common voltage based on the reference voltage, the deviation signal and a feedback input of the first compensated common voltage, wherein the deviation sensing unit detects the deviation of the common voltage from one of an anterior dummy common line, a posterior dummy common line and a dummy gate line in the liquid crystal panel, and wherein the deviation sensing unit includes a direct current (DC) source and a resistor connected to the one of the anterior dummy common line, the posterior dummy common line and the dummy gate line.

2. The circuit according to claim 1, wherein the voltage distributing unit distributes a source voltage to output the reference voltage.

3. The circuit according to claim 2, wherein the voltage distributing unit includes a resistor and a variable resistor connected in series between the source voltage and a ground.

4. The circuit according to claim 1, wherein the first compensating unit includes an operational amplifier (OP AMP) having an inverting input terminal, a non-inverting input terminal and an output terminal.

5. The circuit according to claim 4, wherein the first compensating unit further includes a resistor and a first capacitor connected in series to the inverting input terminal.

6. The circuit according to claim 5, wherein the reference voltage is input to the non-inverting input terminal and the deviation signal is input to the inverting input terminal through the resistor and the first capacitor.

7. The circuit according to claim 5, wherein the first compensating unit further includes a variable resistor and a second capacitor connected in parallel between the output terminal and the inverting input terminal.

8. The circuit according to claim 1, further comprising a second compensating unit compensating the common voltage and outputting a second compensated common voltage by using the first compensated common voltage, a control signal for inverting a parity of the common voltage by frame and an output thereof.

9. The circuit according to claim 8, wherein the first compensating unit adjusts a compensation amount of the common voltage and the second compensating unit adjusts a compensation parity of the common voltage.

10. The circuit according to claim 9, wherein the second compensating unit includes an operational amplifier (OP AMP) having an inverting input terminal, a non-inverting input terminal and an output terminal.

11. The circuit according to claim 10, wherein the second compensating unit further includes a resistor connected to the inverting input terminal.

12. The circuit according to claim 11, wherein the first compensated common voltage is input to the non-inverting input terminal and the control signal is input to the inverting input terminal through the resistor.

13. The circuit according to claim 11, wherein the second compensating unit further includes a variable resistor and a capacitor connected in parallel between the output terminal and the inverting input terminal.

14. The circuit according to claim 10, wherein the second compensating unit further includes an analog buffer connected to the output terminal of the operational amplifier (OP AMP).

15. The circuit according to claim 14, wherein the analog buffer includes first and second transistors connected in series between a source voltage and a ground.

16. The circuit according to claim 14, wherein the second compensating unit further includes a variable resistor and a capacitor connected in parallel between the analog buffer and the inverting input terminal.

17. A method of compensating a common voltage for a liquid crystal display device, comprising:

generating a first common voltage using a reference voltage; in a compensating unit;

detecting a deviation of the first common voltage in a liquid crystal panel to output a deviation signal corresponding to the deviation of the first common voltage, wherein the deviation signal is input to the compensating unit through a resistor and a capacitor, and wherein the resistor and the capacitor are connected to the compensating unit in series; and compensating the first common voltage to output a first compensated common voltage by using the reference voltage, the deviation signal and the first common voltage, wherein the step of detecting the deviation of the first common voltage detects the deviation of the first common voltage from one of an anterior dummy common line, a posterior dummy common line and a dummy gate line in the liguid crystal panel, and wherein the step of detecting the deviation of the first common voltage is performed by a deviation sensing unit including a direct current (DC) source and a resistor connected to the one of the anterior dummy common line, the posterior dummy common line and the dummy gate line.

18. The method according to claim 17, wherein the deviation of the first common voltage is detected by using one of an anterior dummy common line, a posterior dummy common line and a dummy gate line in the liquid crystal panel.

19. A method of compensating a common voltage for a liquid crystal display device, comprising:

generating a first common voltage using a reference voltage in a first compensating unit;

generating a second common voltage using the first common voltage in a second compensating unit;

detecting a deviation of the second common voltage in a liquid crystal panel to output a deviation signal corresponding to the deviation of the second common voltage, wherein the deviation signal is input to the first compensating unit through a resistor and a capacitor, and wherein the resistor and the capacitor are connected to the compensating unit in series;

compensating the second common voltage to output a first compensated common voltage by using the reference voltage, the deviation signal and the first common voltage; and compensating the second common voltage to output a second compensated common voltage by using the first compensated common voltage, a control signal for inverting a parity of the first common voltage by frame and the second common voltage, wherein the step of detecting the deviation of the first common voltage detects the deviation of the second common voltage from one of an anterior dummy common line, a posterior dummy common line and a dummy gate line in the liguid crystal panel, and wherein the step of detecting the deviation of the second common voltage is performed by a deviation sensing unit including a direct current (DC) source and a resistor connected to the one of the anterior dummy common line, the posterior dummy common line and the dummy gate line.

20. The method according to claim 19, further comprising stabilizing the second compensated common voltage by an analog buffer.

21. A system for compensating a common voltage in a liquid crystal display device, comprising:

a liquid crystal (LC) panel;

a voltage distributing unit outputting a reference voltage;

a deviation sensing unit detecting a deviation in a common voltage from the LC panel and outputting a deviation signal corresponding to the deviation in the common voltage; and a first compensating unit coupled with the voltage distributing unit and the deviation sensing unit, and outputting a first compensated common voltage, the first compensating unit comprising:

an input for the reference voltage;

an input for the deviation signal;

a feedback input for the first compensated common voltage;

an output for the first compensated common voltage, the first compensated common voltage being based on the inputs into the first compensating unit; and a resistor and a first capacitor connected in series to the input for the deviation signal;

wherein the first compensated common voltage is applied to the LC panel and the common voltage in the deviation sensing unit comprises the first compensated common voltage, and wherein the deviation signal is input to the input for the deviation signal through the resistor and the first capacitor, wherein the deviation sensing unit detects the deviation of the common voltage from one of an anterior dummy common line, a posterior dummy common line and a dummy gate line in the LC panel, and wherein the deviation sensing unit includes a direct current (DC) source and a resistor connected to the one of the anterior dummy common line, the posterior dummy common line and the dummy gate line.

22. The system according to claim 21, wherein the deviation sensing unit detects the deviation of at least one of the common voltage, the first compensated common voltage, and a combination thereof, from one of an anterior dummy common line, a posterior dummy common line and a dummy gate line in the liquid crystal panel.

23. The system according to claim 21, further comprising a second compensating unit compensating the common voltage and outputting a second compensated common voltage by using the first compensated common voltage, a control signal for inverting a parity of the common voltage by frame and an output thereof.

24. The system according to claim 23, wherein the first compensating unit adjusts a compensation amount of the common voltage and the second compensating unit adjusts a compensation parity of the common voltage.

25. The system according to claim 24, wherein the second compensating unit includes an operational amplifier (OP AMP) having an inverting input terminal, a non-inverting input terminal and an output terminal.

26. The system according to claim 25, wherein the second compensating unit further includes a resistor connected to the inverting input terminal.

27. The system according to claim 26, wherein the first compensated common voltage is input to the non-inverting input terminal and the control signal is input to the inverting input terminal through the resistor.

28. The system according to claim 26, wherein the second compensating unit further includes a variable resistor and a capacitor connected in parallel between the output terminal and the inverting input terminal.

29. The system according to claim 25, wherein the second compensating unit further includes an analog buffer connected to the output terminal of the operational amplifier (OP AMP).

30. The system according to claim 29, wherein the analog buffer includes first and second transistors connected in series between a source voltage and a ground.

31. The system according to claim 29, wherein the second compensating unit further includes a variable resistor and a capacitor connected in parallel between the analog buffer and the inverting input terminal.

* * * * *